United States Patent [19]

Bliss

[11] Patent Number: 4,654,012

[45] Date of Patent: Mar. 31, 1987

[54] METHOD AND APPARATUS FOR REMOVING A SEPARABLE DRIVE TRANSFER AND PROPELLER SHAFT HOUSING

[76] Inventor: Charles R. Bliss, 558 W. Leonard St., Sanford, Mich. 48657

[21] Appl. No.: 849,062

[22] Filed: Apr. 7, 1986

[51] Int. Cl.[4] ..... B63H 5/12

[52] U.S. Cl. ..... 440/53; 114/362; 248/640; 440/113

[58] Field of Search ..... 114/362, 343, 364, 365, 114/221 R, 268; 440/53, 57, 113; 248/640–643; 212/190

[56] References Cited

U.S. PATENT DOCUMENTS 3,857,127 12/1974 Hendrickson ..... 114/362

FOREIGN PATENT DOCUMENTS 880860 11/1981 U.S.S.R. ..... 114/221 R

*Primary Examiner*—Jospeh F. Peters, Jr.

*Assistant Examiner*—Paul E. Salmon

*Attorney, Agent, or Firm*—Learman & McCulloch

[57] ABSTRACT

A method and apparatus for removing the separable drive transfer and propeller shaft housing from the outdrive housing which is mounted to project rearwardly from the lower end of the stern of a boat, under a swimmer's boarding platform projecting rearwardly from the stern. The drive transfer and propeller shaft housing is decoupled from the outdrive housing after a front to rear extending track, clamped to the platform, has its wheeled trolley with a dependent hanger moved along the track under the platform, and the hanger is coupled to the drive transfer and propeller shaft housing. The trolley, with its suspended drive transfer and propeller shaft housing, is then moved rearwardly along the track to an accessible position for work thereon. Thereafter, the drive transfer and propeller shaft housing is moved forwardly along the track under the platform to a position of adjacency with the out drive housing and recoupled with it.

9 Claims, 4 Drawing Figures

METHOD AND APPARATUS FOR REMOVING A SEPARABLE DRIVE TRANSFER AND PROPELLER SHAFT HOUSING

BACKGROUND OF THE INVENTION

This invention relates to boats which have boarding platforms secured to the stern end wall of the boat at a level slightly above the water line, as many pleasure cruisers do. In general, such boarding platforms are structurally integrated with the vessel and constitute permanent obstructions which are outstanding from the boat hull. The platforms are fabricated of high strength, rigid material, for example, fiberglass-wood veneer laminates, and are spaced slightly from the stern end wall of the boat by the brackets which attached to this wall to support the swimmer's platform in cantilevered position.

The substantial internal combustion, marine engines for such boats normally require heavy-duty components, which can be subjected to extended periods of heavy load, and also are able to resist the corrosive action of salt or brackish water. Such marine engines are located within the hull of the boat, but have an outdrive housing projecting rearwardly from the stern end wall of the boat at the lower end thereof, centrally of the stern end wall of the boat. Because of its construction, this outdrive housing may be referred to as the gimbal housing assembly, and it should be understood that it detachably couples to a drive transfer and propeller shaft housing which mounts a propeller on a propeller shaft extending generally horizontally from the lower end of a skeg casing portion.

The latter propeller-incorporating unit is formed with what is termed a bell housing portion which is received within a bell housing bore provided on the gimbal housing assembly. It has a universal jointed drive shaft projecting into and splined to the tubular drive sleeve which projects from the gimbal housing assembly into the bell housing bore. Studs are provided on the gimbal housing assembly to project from it around the bell housing bore, and nuts are provided to releasably clamp the propeller-incorporating drive unit, which has openings receiving the threaded studs, to the gimbal housing assembly.

It is frequently desirable to disassemble the heavy and cumbersome drive unit from the gimbal housing assembly for purposes of maintenance and repair, and normally a lifting eye is provided on the upper end of the drive unit to permit the connection of a suitable support sling. When a swimmer's boarding platform is in place, however, the drive unit cannot be supported from a support above the platform because the platform is in an obstructing location.

SUMMARY OF THE INVENTION

One of the prime objects of the present invention is to provide a simple and reliable method of removing the drive unit to an accessible position so that a workman has ready access to it, and can work on it without the need for simultaneously manually supporting the weight of the drive unit, and possibly injuring himself as a result.

Still another object of the invention is to provide a method of supporting a disassembled drive unit in position under a swimmer's platform in aligned position ready for reassembly.

Still a further object of the invention is to provide a drive unit support structure is designed to substantially envelop the swimmer's boarding platform.

Another object of the invention is to provide a drive unit moving and support structure which can be readily clamped in operative position on a swimmer's platform, and then as easily diassembled from the platform when the separable parts of the engine drive transfer assembly have been recoupled, and the boat is ready for cruising.

The present invention provides a track having a web surface in planar, abutting engagement with the underside of the supporting platform. The track centrally spans the platform and projects rearwardly from it, and a trolley riding along the track has a dependent hook support for detachably coupling with the lifting eye normally provided on the separable propeller-incorporating drive unit. Clamp support members, extend upwardly from the web of the track, support clamps which rigidly and securing clamp the track in position to facilitate disassembly and reassembly of the drive unit.

Other objects and advantages of the invention will become apparent by reference to the following specification and to the drawings.

IN THE DRAWINGS

Figure 1:
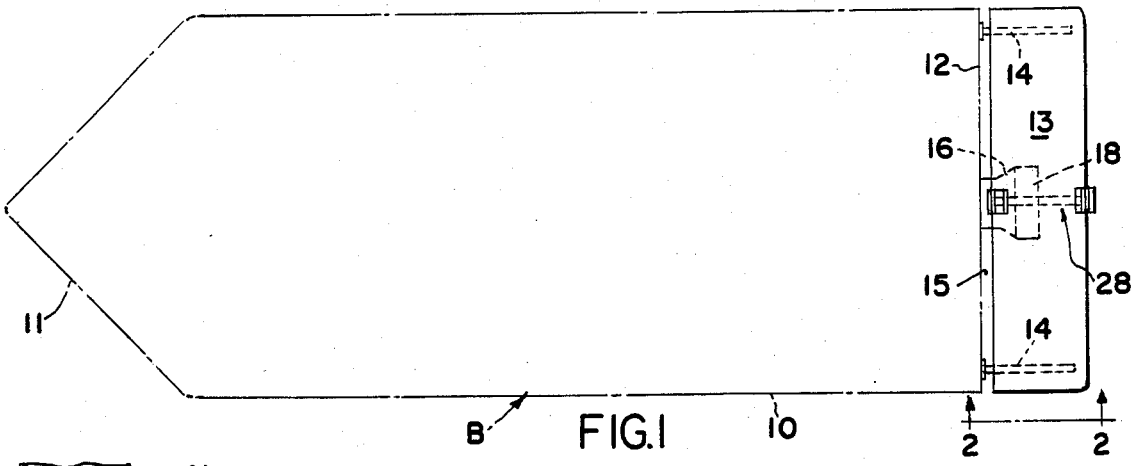
FIG. 1 is a partly schematic, top plan view of a typical cruiser having a swimmer's boarding platform, and showing the drive unit removing apparatus secured in position thereon.

Referring now more particularly to the accompanying drawings, I have schematically disclosed a boat or cruiser at B which, of course, may be of any well-known configuration, and typically includes a hull, generally designated H which has side walls 10, bow end walls 11, and a stern end wall 12. Normally a stern transom is provided at the upper end of stern wall 12, and, typically, a swimmer's boarding platform 13 spans the boat from starboard to leeward side, and projects rearwardly from the stern wall 12. Such platforms 13 are rigidly secured in horizontal position by brackets 14 which may be bolted to both the stern end wall 12 and the underside of platform 13 to support the platform 13 rigidly at a slightly spaced distance 15 from the stern wall 12. Provision may be made for the utilization of brackets 14 of a design which, in one position, rigidly secure the platform 13 in its horizontal position, and, in another, in a released position to permit the platform 13 to pivot upwardly to an inoperative position. Such swimmer's platforms are, for instance, described in U.S. Pat. Nos. 3,613,137 and 3,857,127 which are incorporated herein by reference.

Boats of the character mentioned, which may be described as cruisers, are typically driven at their stern ends by an inboard gasoline engine, such as the Model 260 manufactured by The Mercury Marine Division of Brunswick Corporation, at Fond du Lac, Wis., U.S.A., and sold under its MerCruiser trademark. Such engines E have what may be described as an outdrive or gimbal housing, generally designated 16, which extends through, and projects from, the lower end of the stern wall 12 of the boat B. The outdrive housing 16 typically includes a bell housing bore, housing a tubular drive shaft connected with the engine E, which is driven in rotation thereby. Provided around the flange perimeter 16*a* of the gimbal housing 16 are a series of studs or bolts 17, which function to releasably clamp the separable drive transfer and propeller shaft housing, generally designated 18, or drive unit, to the gimbal housing assembly 16, by way of suitable nuts 19. A mating flange 18*a* on the unit 18 has openings 18*b* through which the threaded studs pass.

Drive unit 18 includes a shaft which is received within the tubular shaft of the gimbal housing, and splined thereto for rotation therewith, the shaft having a univeral joint connection with a take-off shaft provided in the drive unit 18, which transfers the drive to a propeller shaft 22, journaled in a skeg portion 23 of the drive unit which mounts the propeller 24 thereon.

Trim adjusting fluid pressure operated cylinders 25, connected to the gimbal housing 16, have their piston rods 25*a* provided with rings 25*b* for releasably connecting them to pins 26 provided on the drive unit. Typically provided on the upper end of the drive unit is an eye member 27, which is of no use in supporting the drive unit 16 when a boarding platform 13 is also in use.

To obviate the difficulties which have been encountered where boarding platforms are in use, and to provide a solution to the problem of supporting the weight of the drive unit and moving it to an accessible position, after it has been decoupled, I have conceived a drive unit support and transfer apparatus, generally designated 28, which I have uniquely, releasably supported on the boarding platform 13. The apparatus 28 is a welded fabrication comprising an inversely disposed channel, generally designated 29, having a web 29*a* which abuts the underside of the transversely disposed platform 13, and dependent legs 29*b* with inwardly and reversely turned terminal edge portions 29*c*.

The channel 29, at its front end, connects to a front plate 30 which extends a substantial distance upwardly above the platform 13 in abutting relation with the front wall of platform 13. At its rear end, channel 29 projects a substantial distance rearwardly beyond the platform 13, and a series of spaced openings 31 are provided through the web 29 of the channel to permit the anchoring of an angle plate, generally designated 32, which has an upstanding wall 32*a* in abutting engagement with the rear end wall of platform 13. Securing means, comprising a headed stud 33 and nut 34, may be used to adjustably clamp plate 32 in position because, elongate slots are provided in the horizontal leg 32*b* of the angle member 32 to provide for adjusting the position of the angle plate 32 into abutting engagement with the platform 13.

Provided in the vertically extending leg 32*a* of the angle plate 32, are elongate slots 32*c* to accommodate bolts 36 which extend also through the elongate slots 37*c*, provided in the vertical leg 37*a* of an angle clamp plate, generally designated 37, which has a horizontal leg 37*b* in clamped engagement with the platform 13. Suitable nuts and washers 38 are provided to secure the angle plate 37 in vertically adjusted position.

At the opposite end of the device 28, vertically elongate slots 30*a* are provided in the plate 30 to accommodate bolts 39, which extend also through elongated slots 40*a* provided in the vertical leg 40*b* of an angle plate, generally designated 40. The angle plate 40 has a horizontal leg 40*c* in abutting clamping engagement with the platform 13, and nuts and washers 41 may be provided to secure the angle 40 in vertically adjusted position on plate 30. It will be now seen that the platform 13 is substantially enveloped by the track web 29, plate 30, angle plate 40, plate 32, and the angle plate 37.

Figure 2:
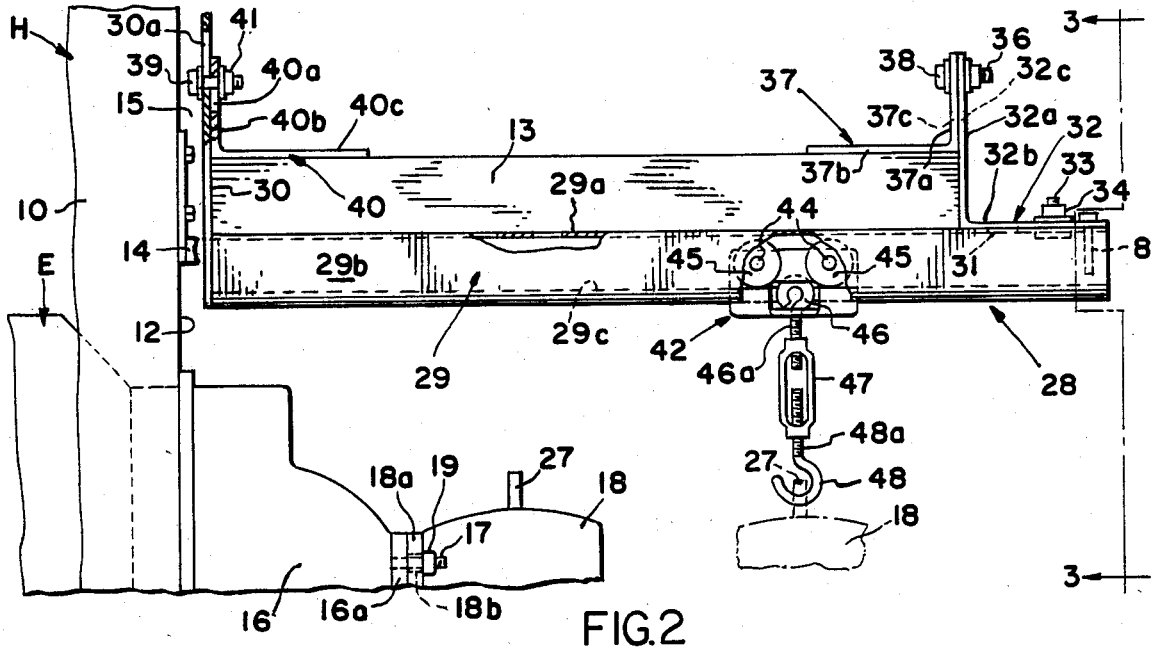
FIG. 2 is a greatly enlarged, side elevational view taken on the line 2—2 of FIG. 1.
Figure 4:
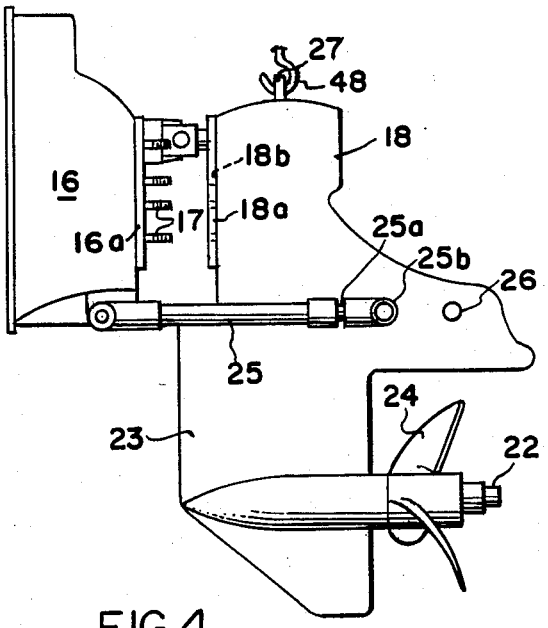
FIG. 4 is a reduced size, side elevational view showing the propeller drive section in the process of being removed.
Figure 3:
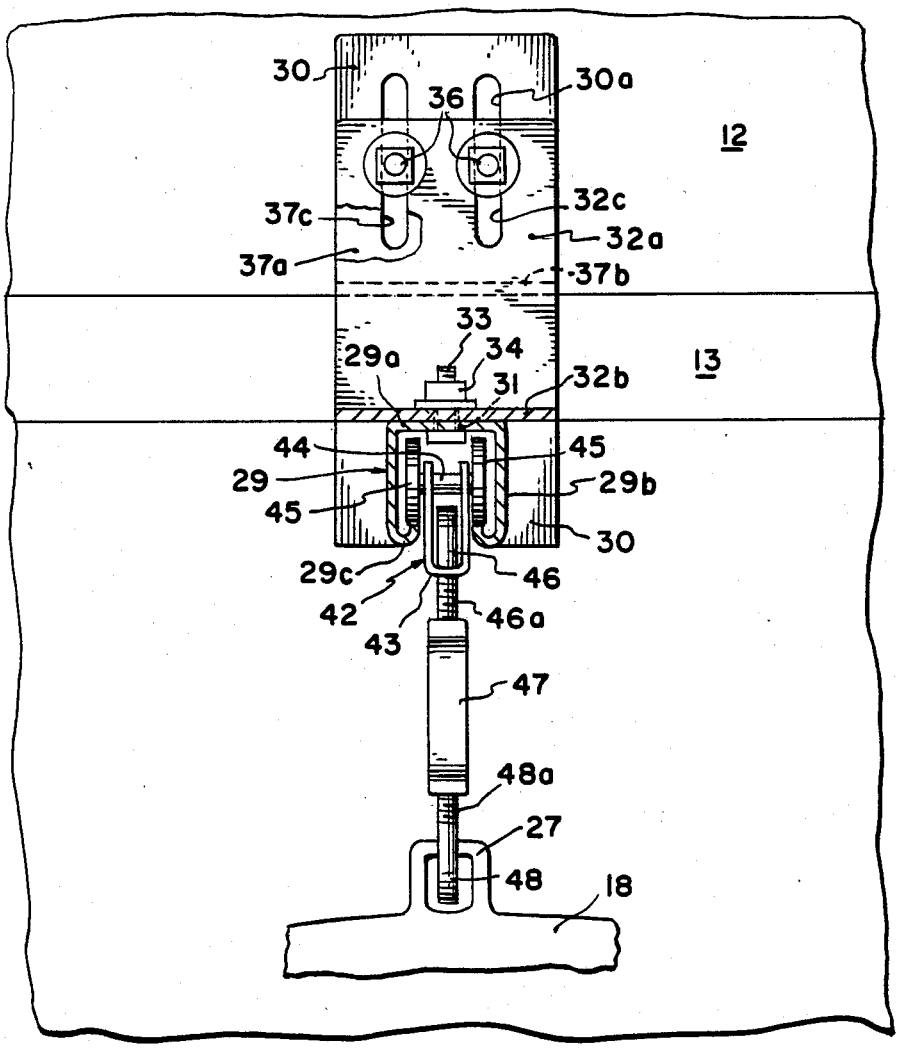
FIG. 3 is a fragmentary, rear elevational view taken on the line 3—3 of FIG. 2.

Provided to travel between the legs 29*b* of the channel 29 in a fore and aft direction, is a trolley generally designated 42, which comprises a U-shaped support 43 spanned by a pair of fixed shafts 44. Front and rear rollers 45 are rotatably mounted on the shafts 44 to travel along the terminal edges 29*c*. An eye member 46, has a threaded shank 46*a* which extends freely through an opening in the support 43, but is threaded into a turnbuckle housing 47, the turnbuckle housing 47, further, having a threaded opening to accommodate the threaded shank 48*a* of a hook 48, which is in position to be received by the eye 27, when the trolley 42 is moved forwardly in FIG. 2. A stop bolt 8 can be anchored in position, as shown in FIG. 2, to extend down into the path of the shafts 44, and prevent the trolley 42 from being withdrawn rearwardly out of the channel 29.

THE OPERATION

In practice, when it is necessary to lubricate or service the gimbal housing or drive unit components, the plate 30 is hooked up into the space 15 between between the boarding platform 13 and hull end wall 12. The plate 40 is then placed in abutting relationship with the plate 30, and clamped in embracing relationship with the platform 13 via the bolts 39 and nuts and washers 41. Angle plate 32 is then clamped via nuts 34 in the position shown in FIG. 2, in which it engages the rear end wall of platform 13, and thereafter angle plate 37 is installed and clamped in vertically adjusted position by manipulating the bolts 35 and nuts and washer 38.

When this has been done, the apparatus 28 is in embracing relationship with the platform 13 and is rigidly clamped thereto. Trolley 42 can then be moved forwardly from the position shown in FIG. 2, to engage in under eye member 27, and then the drive unit 18 can be unclamped from the gimbal housing 16 by removing the nuts 19 from the studs 17, and removing the trim cylinder piston rod rings 25*b* from the pins 26. At this point the full weight of the drive unit 18 is borne by the hook 48, and the trolley 42 can easily be manually moved in a rearward direction to dispose the drive unit 18 in a more accessible position.

After the maintenance has been completed, the trolley unit 42 can then be moved by hand in a forward direction to dispose the drive unit 18 once again in exactly aligned position with the studs 17, and trolley 42 will support the drive unit 18 while the drive unit 18 is recoupled to the gimbal housing 16.

While one embodiment of the invention has been described in detail, it will be apparent to those skilled in the art that the disclosed embodiment may be modified. Therefore, the forgoing description in all aspects is to be considered exemplary rather than limiting in any way, and the true scope of the invention is that defined in the following claims.

What is claimed is:

1. In combination with a boat having a stern drive comprising an inboard engine with an outdrive housing, a separable drive transfer and propeller shaft housing detachably connected to the outdrive housing, a propeller being mounted on a propeller shaft carried by said separable drive transfer and propeller shaft housing, and a swimmer's boarding platform connected with a stern end wall of the boat at a spaced distance below the upper end of said stern end wall above the drive transfer and propeller shaft housing;

a. a track having a web extending transversely to said platform in front-to-rear spanning relationship therewith and projecting rearwardly from said platform;

b. a trolley having wheels riding along said track and having a hanging support dependent from said trolley below said track with a device thereon for detachably coupling with, and supporting for travel, the separable drive transfer and propeller shaft housing;

d. transversely spaced apart front and rear upright plates integrated with and extending upwardly from said web above said platform; and e. clamp members on said plates for embracing the top of said platform and supporting the channel therefrom.

2. The invention defined in claim 1 wherein said device comprises a hook for entering an eye member on said drive transfer and propeller housing.

3. The invention defined in claim 2 wherein said track is an inversely disposed channel and the legs thereof are each provided with a track surface; and said clamp members comprise angle plates with vertical legs detachably and vertically adjustably secured to and abutting the inner faces of said upright plates, and horizontal legs lying on the top surface of said platform; and securing means for clamping said clamp members to said upright plates in a position in which said boarding platform is enveloped by said channel web, upright plates, and clamp members.

4. The invention defined in claim 3 wherein said front upright plate is fixed flush with the front end of said channel so as to be insertable up between said transom and platform, and said rear upright plate is mounted for front to rear adjustment, and securement in adjusted position, along the top surface of said channel web.

5. The invention defined in claim 4 wherein said rear upright plate is an angle member having a rearwardly extending leg; and releasable securing means anchors said rearwardly extending leg to said web.

6. The invention defined in claim 5 wherein said tracks are formed by bending the legs of said channel inwardly.

7. The invention defined in claim 6 wherein said trolley comprises a frame journaling front and rear shafts having pairs of spaced apart wheels thereon riding along said tracks, and dependent threaded shaft, integrated with said trolley frame; said hanging support including a turnbuckle device providing vertical adjustability for said hook.

8. A method of removing the separable drive transfer and propeller shaft housing from the outdrive housing which is mounted in fixed position to project rearwardly from the lower end of the stern end wall of a boat having a transversely extending swimmer's boarding platform provided thereon to project rearwardly from said wall comprising the steps of:

a. decoupling the drive transfer and propeller shaft housing from the outdrive housing;

b. clamping a front-to-rear extending track having a wheeled trolley with a dependent hanger movable along said track to the under surface of said boarding platform;

c. releasably securing said hanger to said drive transfer and propeller shaft housing; and d. moving said trolley with its suspended housing rearwardly along said track to dispose the drive transfer and propeller shaft housing rearwardly of the said platform to an accessible position for work thereon.

9. The method defined in claim 8 wherein said drive transfer and propeller shaft housing is moved forwardly along said track under said platform to a position of adjacency with said drive housing, and recoupled with it.

* * * * *